United States Patent [19]

King et al.

[11] Patent Number: 4,881,787

[45] Date of Patent: Nov. 21, 1989

[54] PACKAGE STORAGE, DISPLAY AND DISPENSING APPARATUS

[75] Inventors: Michael King, Glen Ellyn; Homer F. King, Oakbrook, both of Ill.

[73] Assignee: H. King and Associates, Bensenville, Ill.

[21] Appl. No.: 81,864

[22] Filed: Aug. 5, 1987

[51] Int. Cl.[4] ..... A47F 1/00

[52] U.S. Cl. ..... 312/42; 312/60; 312/297; 211/59.2; 211/184

[58] Field of Search ..... 312/42, 297, 49, 59, 312/60; 221/242, 307, 309, 92; 211/59.2, 184

[56] References Cited

U.S. PATENT DOCUMENTS

| | | | |
|---|---|---|---|
| 1,274,509 | 8/1918 | Burns | 312/50 |
| 2,342,452 | 2/1944 | Casteen | 221/92 X |
| 2,516,122 | 7/1950 | Hughes | 211/184 |
| 3,858,757 | 1/1975 | Langdon | 221/92 |
| 3,883,038 | 5/1975 | Bookout | 221/242 X |
| 4,037,756 | 7/1977 | Jaquish | 312/42 X |
| 4,148,413 | 4/1979 | Immordino | 211/59.2 X |
| 4,305,628 | 12/1981 | Glasener | 312/42 |
| 4,664,291 | 5/1987 | Gunderson | 221/309 |
| 4,682,825 | 7/1987 | Crosslen | 312/42 |

*Primary Examiner*—Joseph Falk

*Attorney, Agent, or Firm*—Donald A. Peterson; Herbert D. Hart, III

[57] ABSTRACT

A storage, display and dispensing apparatus for small regularly shaped packages is provided comprising a tray of generally box-like rectangular configuration having front, rear and side walls, the front wall being of transparent material and having a plurality of finger access notches formed therein. A partial bottom wall is provided extending forwardly from the rear wall and between the side walls to a forward edge at a point spaced rearwardly from the rear of the front wall to form a product or package removal aperture. A plurality of flexible fingers extend from the forward edge terminus of the bottom wall partially into the product removal space. A plurality of product separator areas are slidably disposed in a channel affixed to the interior surface of the rear wall with product separators extending into the interior of the apparatus for maintaining generally rectangular shaped chutes for holding packages or products to be dispensed by manual removal of packages through the U-shaped notches and deforming of the flexible fingers.

7 Claims, 2 Drawing Sheets

FIG. 1
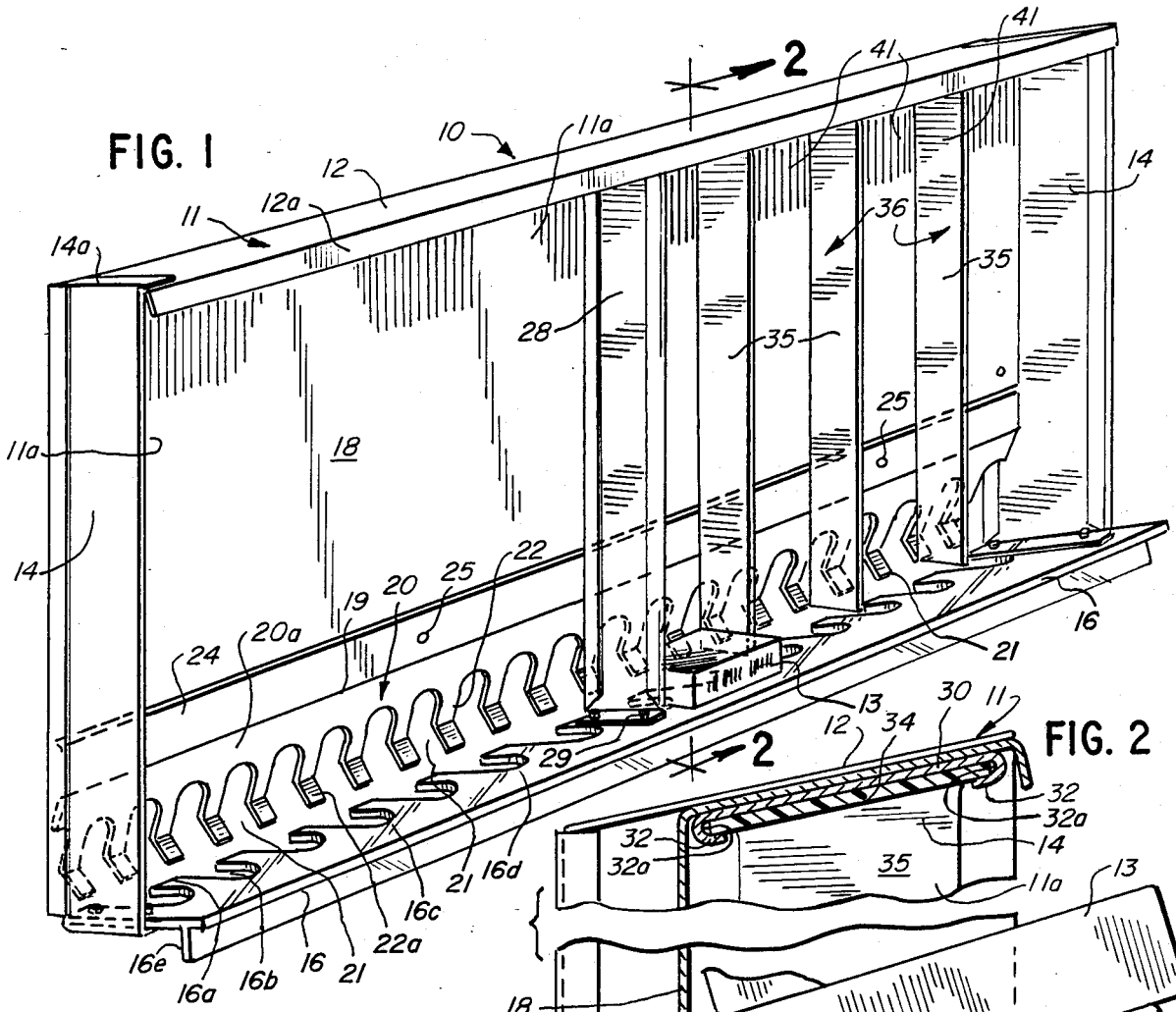
FIG. 2
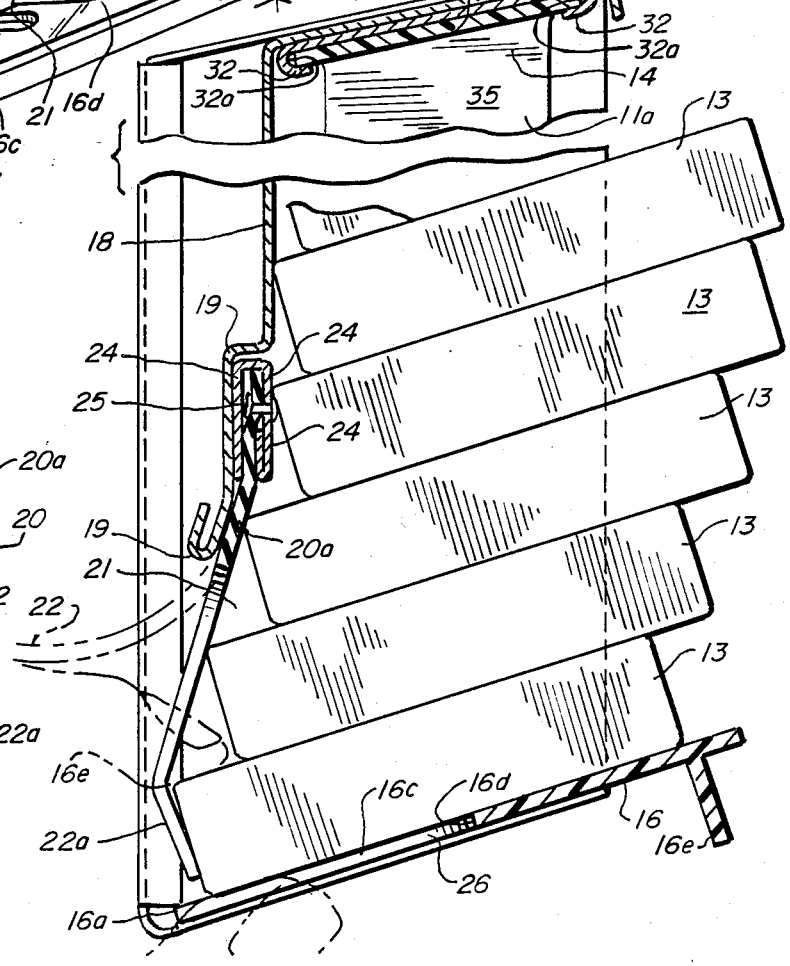
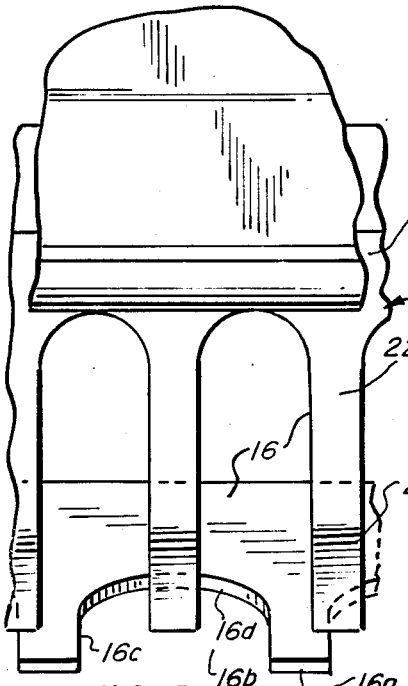
FIG. 3

FIG. 4
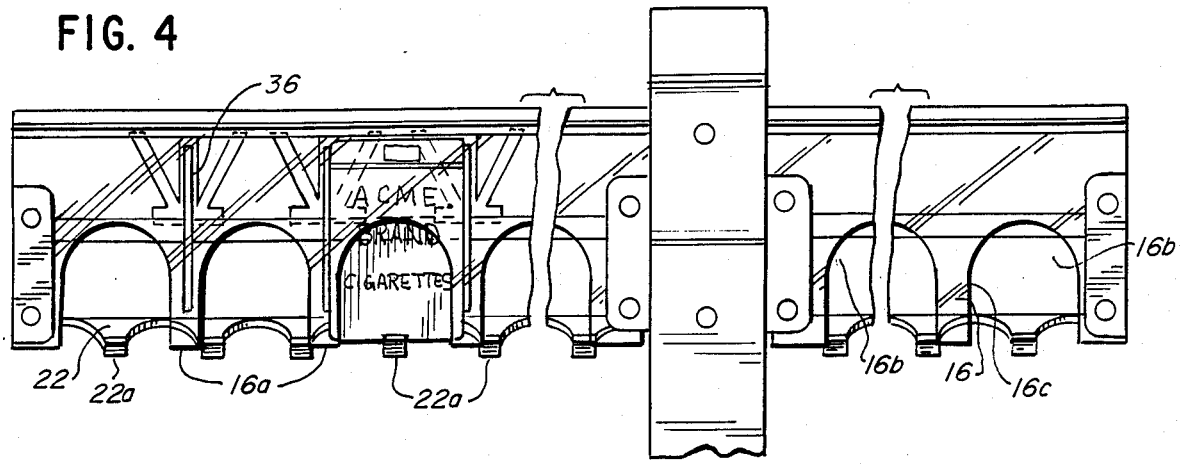
FIG. 5
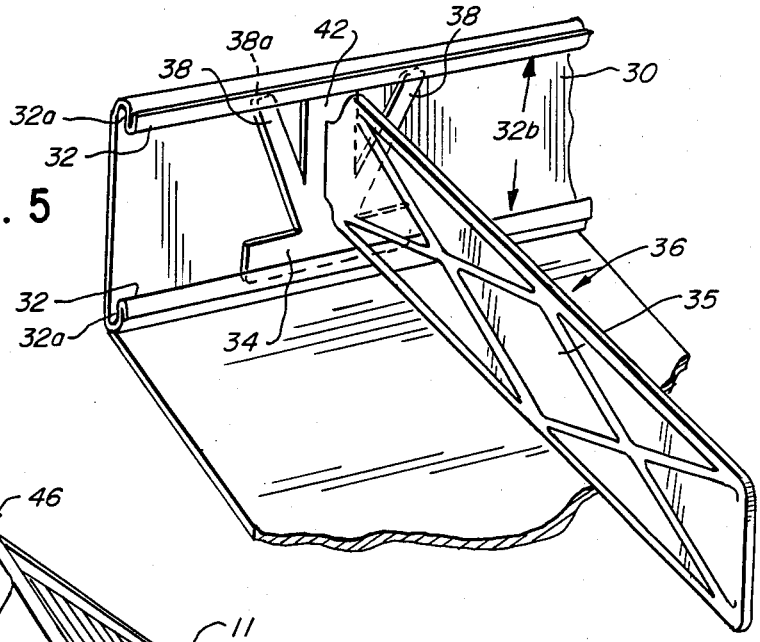
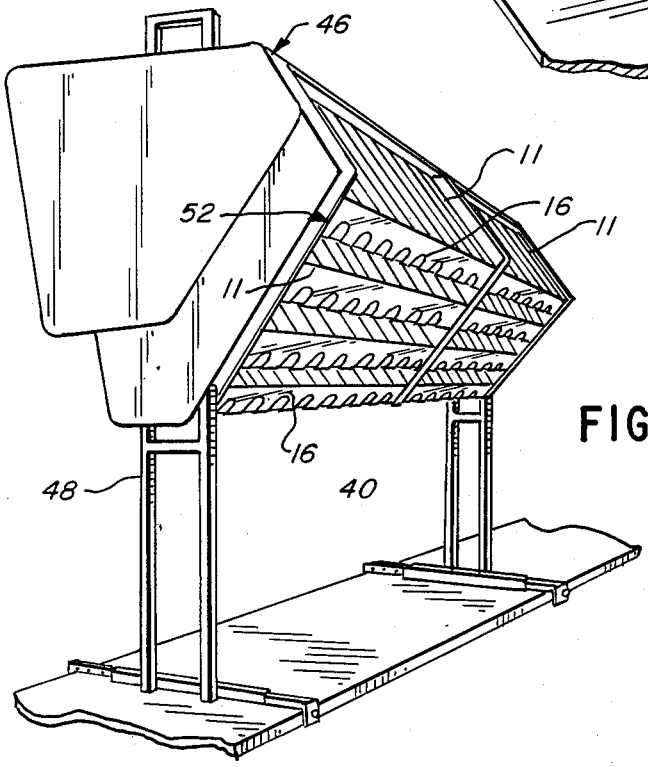
FIG. 6

PACKAGE STORAGE, DISPLAY AND DISPENSING APPARATUS

BACKGROUND OF THE INVENTION

1. Field of the Invention

This invention relates to improvements in package holding, display and dispensing trays for holding, dispensing and display of a plurality of regularly shaped packages of generally rectangular box-like shape such as cigarettes, candy or the like which are readily removable as single units in a retail vending format.

2. Description of the Prior Art

A broad variety of holding, vending and display units for small regularly shaped items are in use. The simplest prior art construction involves an elongated up-ended rectangular three-sided box open on one face and having a plurality of cavities open on one side which in cross-section is essentially the same area as a cigarette pack or small candy box when laid on its side. In such vending unit a stack of box-like packages or small boxes such as cigarette packs or candy, are laid on their sides or flat faces and the top most pack or unit removed singly for vending to a customer.

Such vending units sometimes may have a transparent front face which extends from the top of the front side to a point short of the bottom of the holding cavity for bottom removal of the items. The transparent face sheet permits visual inspection of the brand of tradename of the goods imprinted on the top or bottom end if the package held in the dispensing unit by cavity by the retail clerk as well as a visual determination by the clerk of the amount of the existing stock in the vending unit and the need for refill or restocking. In such constructions, the termination of the transparent front face short of the bottom of the unit, is such so as to permit removal of a single pack from the bottom of the stacked pile or group of boxes or packs such as cigarette packs and the rest of the pile drops down and is ready for removal or dispensing of the next pack. A finger access notch is also often provided for each removal of the packages. This type of construction is exemplified by Casteen, U.S. Pat. No. 2,342,452 (1944). Similar storage display and dispensing units using a variety of specific systems are described in U.S. Pat. No. 3,858,757 (1975) and U.S. Pat. No. 4,148,413 (1979). Generally the constructions shown have as their intended purpose the storage display and serial dispensing of single units or packages for sale.

While these dispensing and display units are generally useful in point of purchase vending, they are not well suited for modern display/vending situation especially those which are placed above eye level in overhead locations either behind a vending counter or above and over the vending counter in a rack accessible to the sales clerk, especially where space is at a premium—such as in cigar counters in commercial office buildings or hotel lobbies, where compact display of a large variety of goods is necessary. Under such circumstances, to reach up and refill the chamber or cavity for the goods from the top of a vending unit is difficult or awkward. Furthermore, the display portion at the bottom or top end of the pack or package bearing the brand name is small (compared to the front face) and careful attention to identify the brands or sub-brands of a given brand name is required to avoid errors and, of course, delay in the sale and servicing of customers.

Accordingly, display and dispensing formats and apparatus used for such purposes which would display the side of the package where the brand name is usually most prominently featured would be desirable and minimize errors by the sales clerk in rapid vending situations as at a cigarette, cigar and candy counter where there are sales transactions frequently taking place at 10–15 second intervals at so-called busy times. Such units adapted for easy loading and particularly adapted for overhead mounting are particularly desirable.

DESCRIPTION OF THE DRAWINGS:

Reference is made to the attached drawing wherein:

FIG. 1 is a perspective view of the improved storage and dispensing tray apparatus of the present invention;

FIG. 2 is a partial enlarged sectional view of the apparatus of FIG. 1 taken along the lines 2—2; and FIG. 3 is an enlarged fragmentary top view of the dispensing apparatus of FIGS. 1 and 2.

FIG. 4 is a reduced scale front elevational view of the apparatus illustrated in FIGS. 1–3.

FIG. 5 is an enlarged partial perspective view of the separator or divider strips mounted in the apparatus of FIGS. 1–4.

FIG. 6 is a perspective view of an overhead rack which may be used to hold a plurality of dispensing trays illustrated in FIG. 1.

SUMMARY OF THE INVENTION

The present invention is directed to a storage, display and dispensing apparatus for holding regularly shaped, generally box-like packages for vending or sale in a point-of-purchase vending context which comprises a tray storage unit or apparatus of generally rectangular shallow box-like shape or configuration, open at the top, having a rear wall, a pair of parallel side walls extending outwardly therefrom, a front wall of transparent material extending between and connected to the side walls, said front wall having a plurality of fingerways formed therein, and a partial bottom wall defining a support surface extending from the juncture of the rear wall with the side walls forwardly between said side walls to a point spaced from the front wall to form a generally rectangular product removal aperture between the front edge of the said bottom surface and the said front wall, and a plurality of flexible finger means affixed to said front edge and extending across said aperture from and between said front edge of said bottom and said front wall, said apparatus including a plurality of adjustable means coacting with support means mounted on said rear wall to adjustably define a plurality of generally rectangular chutes for containing package units to be dispensed from said tray.

DETAILED DESCRIPTION OF THE INVENTION

For a more complete understanding of the present invention, reference is made to the attached drawing and particular FIG. 1 thereof, illustrating the package storage, display and vending apparatus 10 for holding or storing a plurality of packages 13 for vending and sale comprising an open top shallow tray 11 of rectangular box-like form having a rear wall 12, side walls 14, a front wall 16 of a transparent material such as plastic (Plexiglass® [polymethylmethacrylate] or polystyrene) and a partial bottom wall 18 having a front edge 19 terminating short of and at a predetermined distance from the front wall 16, defining a product or package removal space 21.

The bottom wall 18 forward edge 19 has affixed thereto a flexible package retaining member or unit 20 which includes a plurality of flexible resilient fingers 22 which in the embodiment shown, extend and are integrally formed with and as a part of a member or unit 20. In the embodiment shown the fingers 22 have an angularly bent section 22a angled at an obtuse angle toward the face of front wall 16 and space 21. The fingers 22 with angles sections 22a thus extend from an elongated base sector portion 20a of unit 20 which is affixed to and extends the width of the front edge 19 of bottom 18 by a strip-like clamping or retention member 24 secured by rivets or the like 25. The flexible unit 20 is formed of a flexible semi-rigid rubbery plastic material so as to permit deformation of the fingers 22 to permit removal of packages (13) or similar rectangular items or boxes such as a cigarette pack or a small box of candy from the apparatus 10 as is hereinafter more fully described. Suitable materials for use in forming unit 20 are rubberized plastics such as may be exemplified by the plastic sold under the tradename "Santoprene" by the Monsanto Company of St. Louis, Mo.

The transparent front wall or face 16 is provided with a series of regularly spaced finger access ways 16b to form openings or notches 16b extending inwardly from the front bottom edge 16a of wall 16. Each of the generally rectangular openings 16b in face 16 have a pair of side walls 16c extending inwardly from edge 16a to a rounded arcuate connecting top edge 16d.

The rear wall 12 preferably of sheet metal has a front edge 12a folded inwardly toward the cavity 11a of tray 11 and is affixed to side wall 14 by lap joints 14a. A reinforcing means and product divider strip 28 usually made of sheet metal is shown interconnecting the rear wall 12 and front wall 16 using rivets 29 or other conventional fasteners. The reinforcing strip 28 functions to support front wall 16 to prevent undue flexing of the transparent plastic sheet 16 which bears the weight of the packages 13 held in the tray 11 for displaying and dispensing. Because the plurality of notches 16b weaken wall 16, wall 16 also has an integrally formed outwardly extending rib 16e extending outwardly from surface 16 and also acts to reinforce front wall 16 and minimize its flexing.

The rear wall 12 has affixed thereto a C-shaped, separator retaining means or track 30 formed to secure by means of grooves 32a formed by return edges 32 at each side thereof, the foot or base 34 of a movable separators 36 having an extending separator strip 35 of rectangular shape which is integrally formed with the foot or base 34 extending from a central portion (42) thereof as shown in FIGS. 3 and 4. These movable separators shown on FIGS. 3 and 4 are described in Wilcek U.S. patent application Ser. No. 907,116 filed Sept. 12, 1986. As shown, the separator strip 35 functions to divide the cavity 11a of tray 11 into a plurality of cavities 41 for holding the package units 13 to be displayed and dispensed from tray 11.

The base or foot 34 of separator unit 36 is generally T-shaped having an upright portion 42 and a cross-bar portion 40 with a pair of flexible semi-rigid arms 38 extending angularly from the junction crossbar 40 and upright portion 42 of the "T" as shown. The length of the upright member 42 of the T-shaped base is slightly narrower than the distance 32b between the return edges 32 forming grooves 32a of track 30, and on insertion of the cross bar 38 of the base 34 into the C-shaped track 30, the ends 38a of the angular extending arms 38, are flexed an outward base 40 is insertable in the track grooves 32 and is slidable in track 30 laterally disposed across the width of rear wall 12 to provide movable separator means 36 which may be used to neatly divide and segregate a column of neatly stacked packages 13 for storage and dispensing from the apparatus 10. This movable separator unit 36 permits the definition and adjustment of chutes 41 of varying widths to accommodate various sizes of packages 13 (such as cigarette or candy packages or boxes) and serves to prevent mixing of brands and orderly dispensing from the bottom of a stack of product packages arranged in a column in the chute 41.

In use the packages are placed in the chutes 41 defined by the movable separators 36 mounted in the interior 11a in the track 30 affixed to rear wall 12 of tray 11. When the tray 11, mounted in a suitable display apparatus, is in dispensing and display position, the tray bottom 18 is angularly disposed so that transparent front face 16 is so positioned as to be visually observable by a retail or vending clerk.

FIG. 6 illustrates an overhead dispensing rack 46 having supports 48 elevating the rack 46 above a counter surface 50. A plurality of trays 11 are shown on the rear portion 52 of rack 46 arranged with the transparent wall 16 of tray 11 facing angularly downwardly so as to be visible to a retail clerk.

When the packages are placed in the tray 11 in the dispensing mode, the packages, 13 front face, which customarily bears the product brand name, abuts against transparent wall 16 and is readily observable by the clerk. To remove the package 13, the clerk merely reaches through the finger access apertures 16b formed in face 16 (as shown in FIGS. 2 and) 3 and grasps the pack 13 and removes it by withdrawal against the resilient securement of the packages by fingers 22 by deforming the flexible fingers 22 which flex outwardly as shown by broken lines in FIG. 2 to permit removal of a package. After such removal, the fingers 22 because of their flexible, resilient nature, return to their original position shown in solid lines in FIG. 2, to hold the rest of the packages from casual dislodgement from the tray 11.

The dispensing tray apparatus is thus useful to store and dispense regularly shaped packages for sale to a consumer in a retail vending situation. Additionally when said trays are disposed in an overhead display rack such as FIG. 6, the brand printed on the flat is clearly visible through the transparent wall 16 and thus reduces error in vending and the sales clerk time is spent filling the customers order.

What is claimed is:

1. An apparatus for storage, display and dispensing of regularly shaped packages which comprises a tray of generally box-like shape open at the top having generally rectangular front and rear walls and a pair of spaced apart parallel side walls each connected to and extending between the ends of said front and rear walls at essentially right angles thereto, said front wall being formed of transparent material having a plurality of U-shaped finger-way notches open toward the bottom formed therein, a partial bottom wall defining a package support surface extending between the side walls and from the rear wall to a front edge point spaced from the rear surface of said front wall to form a product removal aperture between the front edge of the bottom wall and the rear surface of said front wall, and means including a plurality of flexible finger means affixed to and extending from the front edge of the bottom wall and partially across said product removal aperture and towards said finger notches to contact and secure packages stored in said apparatus, said notches providing finger access to packages stored in said apparatus, which packages may be removed by deformation of the flexible finger means.

2. An apparatus according to claim 1 wherein said flexible finger means comprises a strip-like securement sector means of flexible, rubbery resilient material affixed to and extending outwardly from and across said front edge of the bottom wall and a plurality of regularly spaced finger means integrally formed with and extending outwardly from said strip-like securement sector defining a plurality of uniform spaces separating said finger means.

3. An apparatus according to claim 2 wherein said finger means comprise strip-like finger elements having a first sector extending outwardly and essentially coplanar to the strip-like securement element means for a predetermined distance and second sector uniformly extending outwardly at an oblique angle to said first sector upwardly into the cavity defined by the front, rear and side walls of said apparatus.

4. An apparatus according to claim 1 including a plurality of adjustable striplike means slidably mounted at one end in channel support means mounted on the interior surface of said rear wall, said separator means being disposed above the bottom wall surface and extending outwardly from the rear wall to adjustably define a plurality of generally rectangular chutes for containing packages to be dispensed.

5. An apparatus according to claim 4 wherein said channel support means comprises a C-shaped channel means affixed to said rear wall interior surface, said channel means including a pair of spaced apart inwardly extending lips spaced upwardly from the rear surface of said channel forming a pair of parallel slots extending essentially the width of said rear wall for sliding and cooperative engagement with the said adjustable movable separator means.

6. An apparatus according to claim 4 wherein said adjustable separator means generally rectangular comprises a base element for sliding movable engagement with the C-shaped channel of said support means and a generally rectangular shaped separator means affixed to and extending outwardly at right angles to said base element, said base element including a T-shaped element having an integrally formed upright portion, a cross bar, and a pair of integrally formed flexible arms each of which extends angularly from the juncture of the cross bar and the upright element of the T-shaped base element, to a point slightly beyond, the free end of said upright element, said base element being insertable and removable from said channel by deformation of the flexible areas.

7. An apparatus for storage, display and dispensing of regularly shaped packages which comprises a tray of generally box-like shape open at the top having front and rear walls, and a pair of spaced apart side walls connected at their respective end to the ends of the said front and rear walls at essentially right angles thereto, said front wall being of transparent material and having a plurality of U-shaped finger-way notches open towards the bottom thereof formed therein, a partial bottom wall defining a package support surface extending between the side walls and forwardly from the rear wall to a forward edge spaced from the front wall to form a package removal aperture between the front edge of the bottom wall and the front wall, flexible means including a plurality of integrally formed flexible finger means affixed to and extending from the front edge of the bottom wall toward said finger-way notches and partially across said aperture;

a C-shaped support channel means affixed to the interior surface of said rear wall and extending substantially the width thereof; and a plurality of adjustable package separator means coacting with and slidably mounted at one end thereof in said C-shaped channel said adjustable means including a base element for cooperative engagement with said channel and a strip-like generally rectangular product separator element extending generally at right angles to said base element said separator elements adjustably defining a plurality of generally rectangular chutes for containing and segregating packages to be dispensed from said apparatus.

* * * * *